US010301926B2

(12) United States Patent
Bittar et al.

(10) Patent No.: US 10,301,926 B2
(45) Date of Patent: May 28, 2019

(54) CASING DETECTION TOOLS AND METHODS

(71) Applicant: Halliburton Energy Services, Inc., Houston, TX (US)

(72) Inventors: Michael S. Bittar, Houston, TX (US); Hsu-Hsiang Wu, Sugarland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/191,152

(22) Filed: Nov. 14, 2018

(65) Prior Publication Data

US 2019/0078433 A1 Mar. 14, 2019

Related U.S. Application Data

(63) Continuation of application No. 14/239,364, filed as application No. PCT/US2011/048317 on Aug. 18, 2011, now Pat. No. 10,145,234.

(51) Int. Cl.
*G01V 3/00* (2006.01)
*E21B 47/04* (2012.01)
(Continued)

(52) U.S. Cl.
CPC ..... *E21B 47/04* (2013.01); *E21B 7/04* (2013.01); *E21B 43/2406* (2013.01); *E21B 47/02216* (2013.01)

(58) Field of Classification Search
CPC ... G01V 3/28; G01V 3/30; G01V 3/18; G01V 3/12; G01V 3/20; E21B 47/024;
(Continued)

(56) References Cited

U.S. PATENT DOCUMENTS 3,748,573 A * 7/1973 Vogel ..... G01V 3/24 324/369
5,541,517 A * 7/1996 Hartmann ..... E21B 47/02216 175/45
(Continued)

FOREIGN PATENT DOCUMENTS

AU 2011202215 A1 1/2012
AU 2011202518 A1 1/2012
(Continued)

OTHER PUBLICATIONS

Australian Patent Application No. 2011375008, Examination Report No. 1 dated Apr. 7, 2015.
(Continued)

*Primary Examiner* — Naomi J Small
(74) *Attorney, Agent, or Firm* — Gilliam IP PLLC

(57) ABSTRACT

Methods and tools for detecting casing position downhole is presented. The method utilizes electromagnetic (EM) tools with tilted antenna systems to detect casing position. Sometimes titled antenna designs also increase EM tools' sensitivity to formation parameters, which can lead to false signals for casing detection. In addition, it is very difficult to distinguish measured signals between a casing source and a formation source. The methods presented help to distinguish between the two sources more clearly. The methods and tools presented also help to minimize those environmental effects, as well as enhance the signals from a surrounding conductive casing. The methods herein provide ideas of EM tool's design to precisely determine casing position within a certain distance to casing position.

20 Claims, 14 Drawing Sheets

(51) Int. Cl.
*E21B 7/04* (2006.01)
*E21B 47/022* (2012.01)
*E21B 43/24* (2006.01)

(58) Field of Classification Search
CPC .... E21B 47/122; E21B 49/00; E21B 43/2406; E21B 47/02216; E21B 47/04; E21B 7/04
USPC ..... 340/854.1
See application file for complete search history.

(56) References Cited

U.S. PATENT DOCUMENTS 5,892,460 A 4/1999 Jerabek et al.
6,163,155 A 12/2000 Bittar
6,257,334 B1 7/2001 Cyr et al.
6,476,609 B1 11/2002 Bittar
6,911,824 B2 6/2005 Bittar
7,010,429 B2 * 3/2006 Xiao ..... G01V 3/28 702/7
7,018,528 B2 3/2006 Lee
7,138,803 B2 11/2006 Bittar
7,265,552 B2 9/2007 Bittar
7,382,135 B2 6/2008 Li
7,557,579 B2 7/2009 Bittar
7,557,580 B2 7/2009 Bittar
7,659,722 B2 2/2010 Bittar
7,825,664 B2 11/2010 Homan et al.
7,948,238 B2 5/2011 Bittar
8,026,722 B2 9/2011 McElhinney
8,085,049 B2 12/2011 Bittar
8,274,289 B2 9/2012 Bittar et al.
8,756,015 B2 * 6/2014 Meyer ..... G01V 3/28 702/7
2002/0017905 A1 * 2/2002 Conti ..... G01V 3/28 324/339
2004/0149434 A1 * 8/2004 Frey ..... E21B 43/086 166/250.1
2005/0140373 A1 6/2005 Li et al.
2006/0011385 A1 * 1/2006 Seydoux ..... G01V 3/28 175/61
2007/0137854 A1 6/2007 Homan et al.
2008/0078580 A1 4/2008 Bittar
2008/0136419 A1 * 6/2008 Seydoux ..... G01V 3/28 324/333
2009/0159276 A1 * 6/2009 Chouzenoux ..... E21B 47/122 166/254.1
2009/0164127 A1 6/2009 Clark
2009/0179647 A1 7/2009 Wang et al.
2009/0230968 A1 * 9/2009 Bittar ..... E21B 47/024 324/338
2009/0309600 A1 12/2009 Seydoux et al.
2010/0044035 A1 * 2/2010 Bespalov ..... E21B 47/022 166/255.1
2010/0044108 A1 * 2/2010 Bespalov ..... E21B 47/022 175/24
2010/0049442 A1 2/2010 Meyer
2010/0244842 A1 * 9/2010 Wang ..... G01V 3/28 324/338
2010/0283469 A1 11/2010 Wang
2011/0006773 A1 1/2011 Bittar
2011/0199088 A1 8/2011 Bittar
2011/0221442 A1 9/2011 Maurer et al.
2012/0001637 A1 1/2012 Bittar et al.
2012/0194195 A1 * 8/2012 Wisler ..... E21B 47/02216 324/346
2012/0283952 A1 11/2012 Tang et al.

FOREIGN PATENT DOCUMENTS

CN 101852078 A 10/2010
WO 200808386 A1 1/2008
WO 2008008346 A1 1/2008
WO 2010039357 A1 4/2010
WO 2011129828 A1 10/2011
WO 2012121697 A1 9/2012
WO 2013025222 A1 2/2013

OTHER PUBLICATIONS

Canadian Patent Application No. 2,821,127, Office Action dated Mar. 26, 2015.
Canadian Patent Application No. 2,844,111, First Examiner's Letter dated May 8, 2015.
Chinese Application Serial No. 201180072865.3; Chinese Office Action dated Aug. 15, 2016.
European Patent Application No. 11870884.1, EP Search Report dated Jun. 2, 2015.
GB Patent Application No. GB1109401.8, Combined Search & Examination report dated Sep. 16, 2011.
GB Patent Application No. GB1109401.8, Examination Report dated Aug. 8, 2012.
My Application Serial No. PI 2014000325, Substantive Examination Adverse Report, dated May 31, 2018, 3 pages.
PCT Application No. PCT/US2011/048317, International Search Report and Written Opinion, dated Dec. 15, 2011.
PCT Application No. PCT/US2011/048317, Preliminary Report on Patentability, dated Sep. 12, 2013.
Russian Patent Application No. 2014106048/03, First Office Action dated Mar. 20, 2015.
Russian Patent Application No. 2014106048/03, Second Office Action dated Jul. 2, 2015.
Mexican First Office Action; Application Serial No. MX/a/2014/001803; dated Feb 20, 2018, 3 Pages.
EP Application Serial No. 11870884.1; Communication Pursuant to Article 94(3); dated Mar. 19, 2018, 5 Pages.

* cited by examiner

CASING DETECTION TOOLS AND METHODS

BACKGROUND

The world depends on hydrocarbons to solve many of its energy needs. Consequently, oil field operators strive to produce and sell hydrocarbons as efficiently as possible. Much of the easily obtainable oil has already been produced, so new techniques are being developed to extract less accessible hydrocarbons. These techniques often involve drilling a borehole in close proximity to one or more existing wells. One such technique is steam-assisted gravity drainage ("SAGD") as described in U.S. Pat. No. 6,257,334, "Steam-Assisted Gravity Drainage Heavy Oil Recovery Process". SAGD uses a pair of vertically-spaced, horizontal wells less than 10 meters apart, and careful control of the spacing is important to the technique's effectiveness. Other examples of directed drilling near an existing well include intersection for blowout control, multiple wells drilled from an offshore platform, and closely spaced wells for geothermal energy recovery.

One way to direct a borehole in close proximity to a cased well is through the use of electromagnetic (EM) logging tools. EM logging tools are capable of measuring a variety of formation parameters including resistivity, bed boundaries, formation anisotropy, and dip angle. Because such tools are typically designed for measuring such parameters, their application to casing detection may be adversely impacted by their sensitivity to such environmental parameters. Specifically, the tool's response to nearby casing can be hidden by the tool's response to various environmental parameters, making it impossible to detect and track a cased well, or conversely making the tool produce false detection signals that could deceive the drilling team into believing they are tracking a nearby cased well when such is not the case. Such difficulties do not appear to have been previously recognized or adequately addressed. The disclosure generally relates to the field of Choose an item, and more particularly to Choose an item.

BRIEF DESCRIPTION OF THE DRAWINGS

A better understanding of the various disclosed system and method embodiments can be obtained when the following detailed description is considered in conjunction with the drawings, in which.

Figure 1:
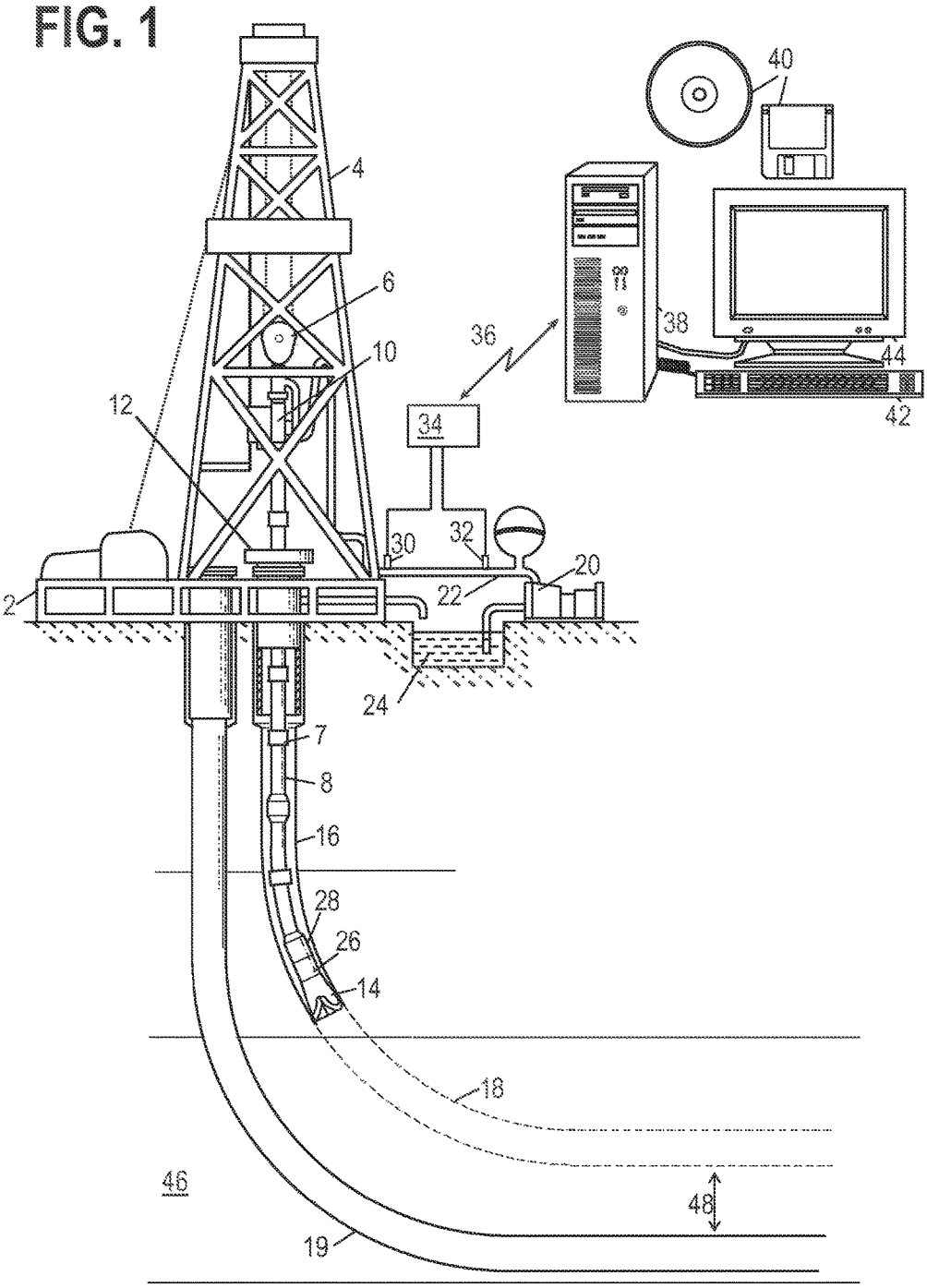
FIG. 1 shows an illustrative drilling environment in which electromagnetically-guided drilling may be employed.

While the invention is susceptible to various alternative forms, equivalents, and modifications, specific embodiments thereof are shown by way of example in the drawings and will herein be described in detail. It should be understood, however, that the drawings and detailed description thereto do not limit the disclosure, but on the contrary, they provide the foundation for supporting all alternative forms, equivalents, and modifications falling within the scope of the appended claims.

DESCRIPTION

The issues identified in the background are at least in part addressed by the disclosed casing detection tools and methods. At least one disclosed method embodiment includes obtaining formation resistivity measurements from a first borehole. Based at least in part on these measurements, an expected environmental signal level is determined for a second borehole at a specified position relative to the first borehole. At least one of a transmitter-receiver spacing and an operating frequency is then selected to provide a desired detection signal level for the first borehole from the second borehole, such that the desired detection signal level will be greater than the expected environmental signal level, and a bottomhole assembly (BHA) is constructed with a tilted antenna logging tool having the selected spacing and/or operating frequency for use in the second borehole.

At least one disclosed tool embodiment includes a tilted transmit antenna and two or more tilted receive antennas at least a selected spacing distance from the transmit antenna to detect components of a response to the transmit signal. The transmit signal has a frequency at or below a selected operating frequency, the frequency being selected in conjunction with the spacing to ensure that the expected casing detection signal level is greater than an expected environmental signal level.

To further assist the reader's understanding of the disclosed systems and methods, we describe an environment suitable for their use and operation. Accordingly, FIG. 1 shows an illustrative geosteering environment. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations. A pump 20 circulates drilling fluid through a feed pipe 22 to top drive 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity.

The drill bit 14 is just one piece of a bottom-hole assembly that includes one or more drill collars (thick-walled steel pipe) to provide weight and rigidity to aid the drilling process. Some of these drill collars include logging instruments to gather measurements of various drilling parameters such as position, orientation, weight-on-bit, borehole diameter, etc. The tool orientation may be specified in terms of a tool face angle (a.k.a. rotational or azimuthal orientation), an inclination angle (the slope), and a compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. In some embodiments, the tool face and hole inclination angles are calculated from the accelerometer sensor output. The magnetometer sensor outputs are used to calculate the compass direction.

The bottom-hole assembly further includes a ranging tool 26 to induce a current in nearby conductors such as pipes, casing strings, and conductive formations and to collect measurements of the resulting field to determine distance and direction. Using these measurements in combination with the tool orientation measurements, the driller can, for example, steer the drill bit 14 along a desired path 18 relative to the existing well 19 in formation 46 using any one of various suitable directional drilling systems, including steering vanes, a "bent sub", and a rotary steerable system. For precision steering, the steering vanes may be the most desirable steering mechanism. The steering mechanism can be alternatively controlled downhole, with a downhole controller programmed to follow the existing borehole 19 at a predetermined distance 48 and position (e.g., directly above or below the existing borehole).

A telemetry sub 28 coupled to the downhole tools (including ranging tool 26) can transmit telemetry data to the surface via mud pulse telemetry. A transmitter in the telemetry sub 28 modulates a resistance to drilling fluid flow to generate pressure pulses that propagate along the fluid stream at the speed of sound to the surface. One or more pressure transducers 30, 32 convert the pressure signal into electrical signal(s) for a signal digitizer 34. Note that other forms of telemetry exist and may be used to communicate signals from downhole to the digitizer. Such telemetry may employ acoustic telemetry, electromagnetic telemetry, or telemetry via wired drillpipe.

The digitizer 34 supplies a digital form of the telemetry signals via a communications link 36 to a computer 38 or some other form of a data processing device. Computer 38 operates in accordance with software (which may be stored on information storage media 40) and user input via an input device 42 to process and decode the received signals. The resulting telemetry data may be further analyzed and processed by computer 38 to generate a display of useful information on a computer monitor 44 or some other form of a display device. For example, a driller could employ this system to obtain and monitor drilling parameters, formation properties, and the path of the borehole relative to the existing borehole 19 and any detected formation boundaries. A downlink channel can then be used to transmit steering commands from the surface to the bottom-hole assembly.

Figure 2:
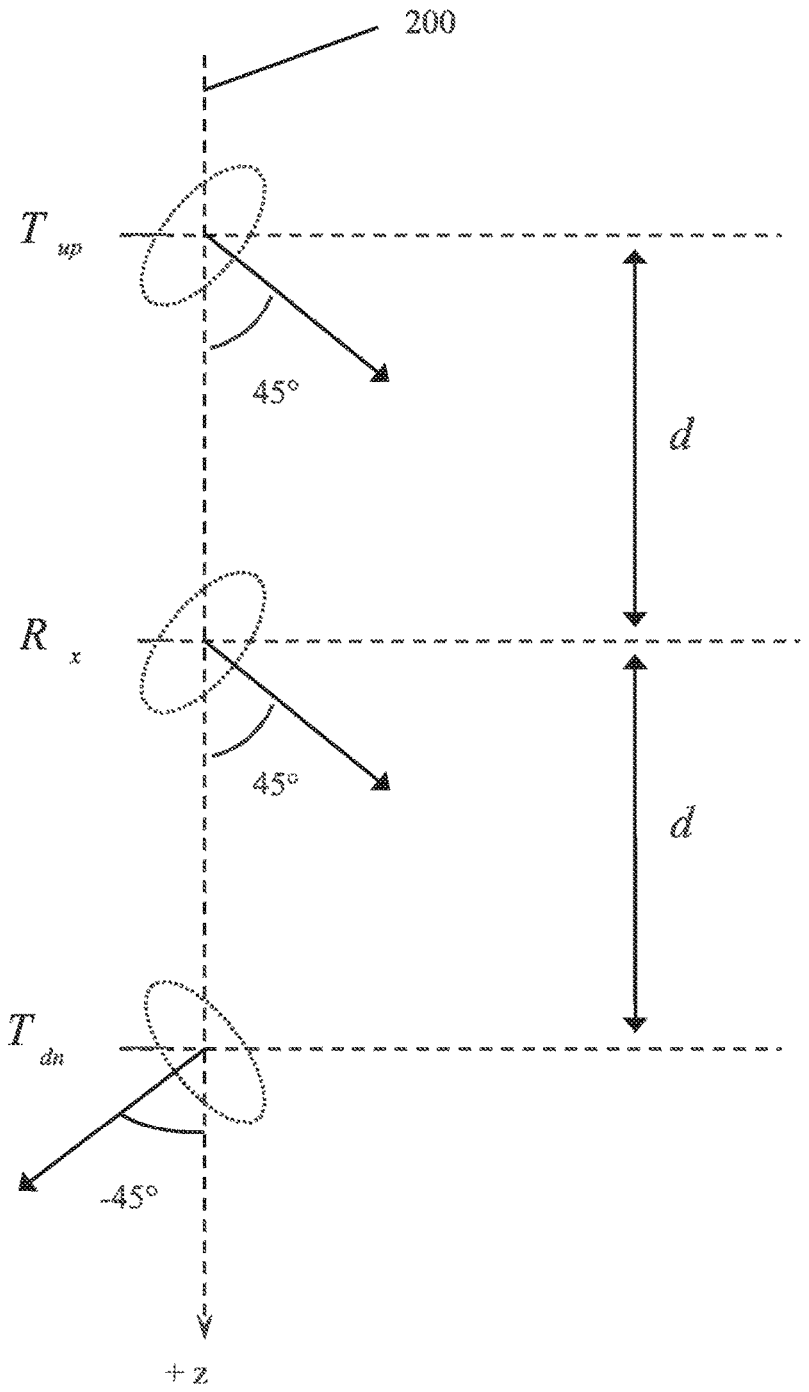
FIG. 2 is an illustrative tilted antenna system with parallel and perpendicular transmitter-receiver pairs.

FIG. 2 shows an illustrative antenna configuration for ranging tool 26. This particular antenna configuration is used below as a specific example for explaining the relative effects of environmental parameters as contrasted with a nearby casing string, but the conclusions are applicable to nearly all electromagnetic logging tools having at least one tilted antenna. Accordingly, the following discussion is not limiting on the scope of the disclosure. The illustrated configuration includes two transmit antennas (labeled Tup and Tdn) and a receive antenna (labeled Rx) midway between the two. Each of the antennas is tilted at 45° from the longitudinal axis of the tool, such that the receive antenna is parallel to one transmit antenna and perpendicular to the other. The centers of the antennas are equally spaced, with d being the distance between the receiver and each transmit antenna. As the tool rotates, the transmitters fire alternately and the receive signals detected by the receiver in response the transmitters Tup and Tdn are $V_{Rx}^{Tup}(\beta)$ and $V_{Rx}^{Tdn}(\beta)$, respectively, where β is tool's azimuthal angle. The tool's responses to a nearby casing string, a nearby fluid interface or bed boundary, or to an anisotropic dipping formation, is expected to take the following form:

$$V_{Rx}^{Tup}(\beta)=A_1\cos(2\beta)+B_1\cos(\beta)+C_1$$

$$V_{Rx}^{Tdn}(\beta)=A_2\cos(2\beta)+B_2\cos(\beta)+C_2 \quad (1)$$

where $A_i$, $B_i$, and $C_i$ are complex coefficients representing the voltage amplitude of azimuthal-dependent double-period sine wave, a single-period sine wave, and a constant value for the receiver's response to the upper transmitter (i=1) or lower transmitter (1=2). Using a curve fitting function, the three complex voltage amplitudes for each response can be derived from the raw measured signal voltages in a straightforward manner. Experiments indicate that when the coefficients for the tool's response to a nearby casing string are compared to coefficients for the tool's response to environmental parameters, the $A_i$ coefficient for the casing string response has a larger magnitude than the $B_i$ coefficient, while for responses to environmental parameters the reverse is generally true. Indeed, the $B_i$ coefficient for the casing string response has been found to be relatively small compared to the $A_i$ coefficient. Accordingly, the proposed casing detection tool preferably employs the $A_i$ coefficient for detection and ranging measurements. Temperature compensation and voltage normalization can be accomplished by using the ratio $|A_i/C_i|$, and it has been found useful to employ a logarithm of this ratio, e.g., $\log 10(|A_i/C_i|)$, when modeling the tool's operation.

Figure 3A:
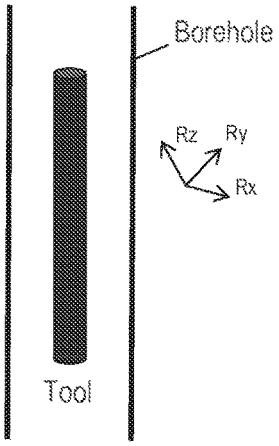
FIGS. 3A, 3B, and 3C show illustrative drilling environments and arrangements of a tool within a formation.
Figure 3B:
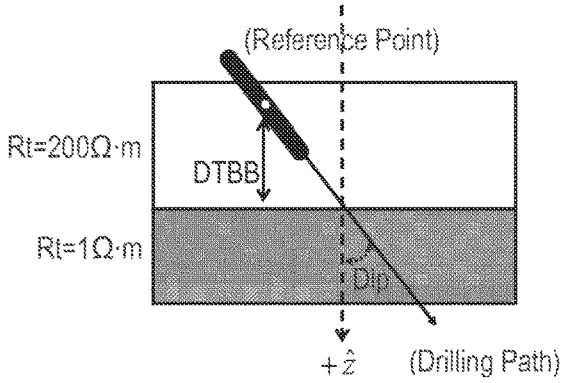
Figure 3C:
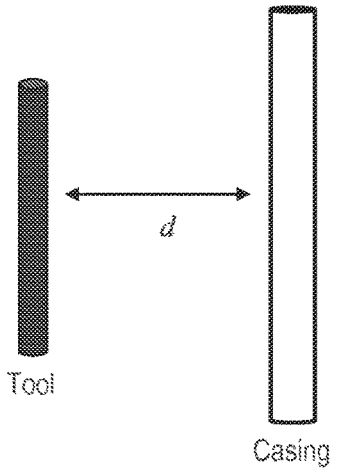

Three representative models will be employed to analyze the tool's response to (1) formation anisotropy; (2) a nearby boundary; and (3) a casing string. FIG. 3A shows a first model in which a tool is positioned in a relatively thick dipping formation having resistive anisotropy. The horizontal resistivity (Rx and Ry) is taken as 1 Ωm, while the vertical resistivity (Rz) is taken as 2 Ωm. FIG. 3B shows a second model in which the tool is in a resistive formation ($R_t$=200 Ωm) and is approaching a boundary with a more conductive formation ($R_t$=1 Ωm). The tool's distance to the bed boundary (DTBB) is measured from the receive antenna to the closest point on the boundary. FIG. 3C shows a third model in which the tool is positioned at a distance d from a casing string in an otherwise homogeneous formation.

Figure 4B:
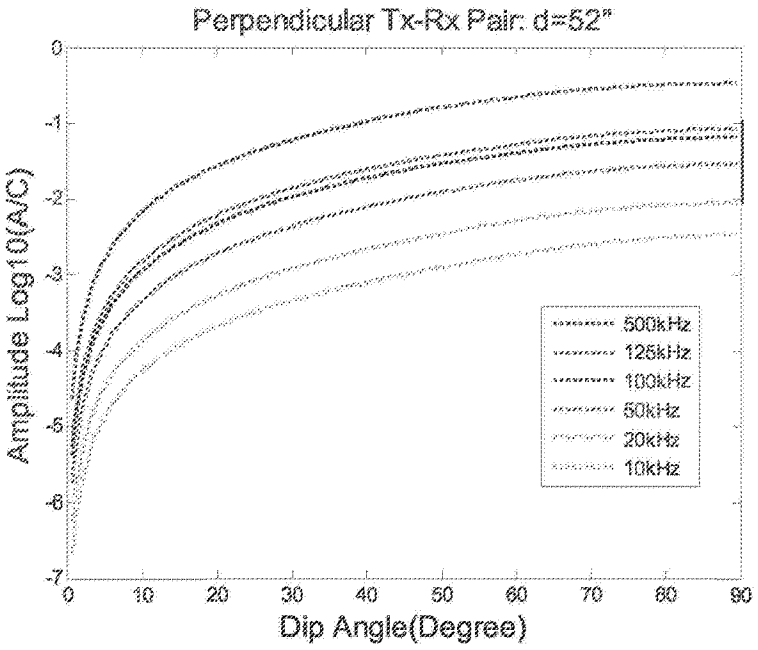
FIGS. 4A and 4B are modeled tool responses to formation anisotropy as a function of frequency and dip angle.
Figure 4A:
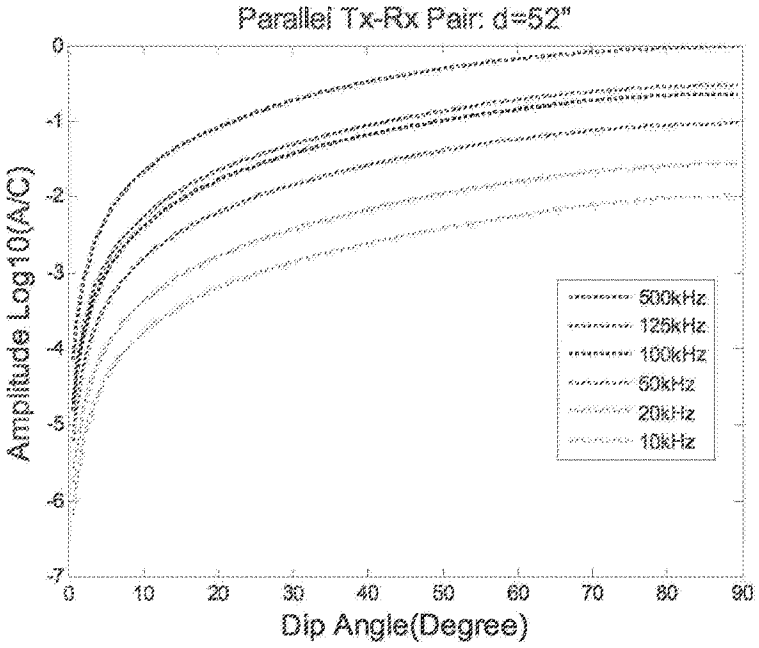

The tool's responses to each of these three models are compared, beginning with the anisotropy model. FIG. 4A shows the measurements by the parallel transmit-receive antenna pair (hereafter the "parallel response") with a 52 inch spacing between the antennas, while FIG. 4B shows the measurements by the perpendicular transmit-receive antenna pair with the same spacing. In both cases, the measurements are shown as a function of dip angle and transmit signal frequency. The measurements are shown in terms of the logarithm of the coefficient ratio, i.e., log $10(|A_i/C_i|)$. Generally speaking, a stronger anisotropy response is observed at higher signal frequencies. Moreover, the tool measurements are fairly steady at dips of greater than 10 degrees, but they fall off sharply at smaller dip angles as the model becomes more symmetric about the tool axis.

Figure 5A:
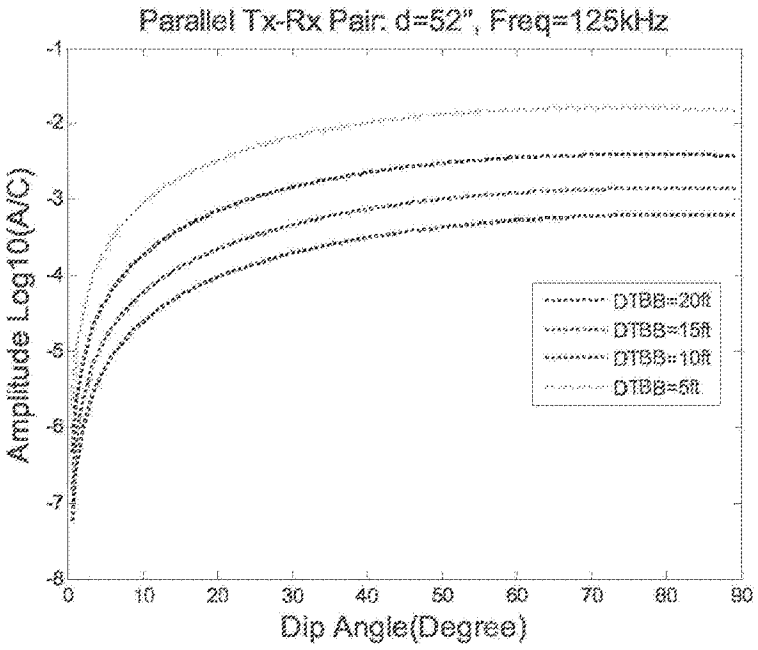
FIGS. 5A and 5B are modeled tool responses to a nearby boundary as a function of boundary distance and dip angle.
Figure 5B:
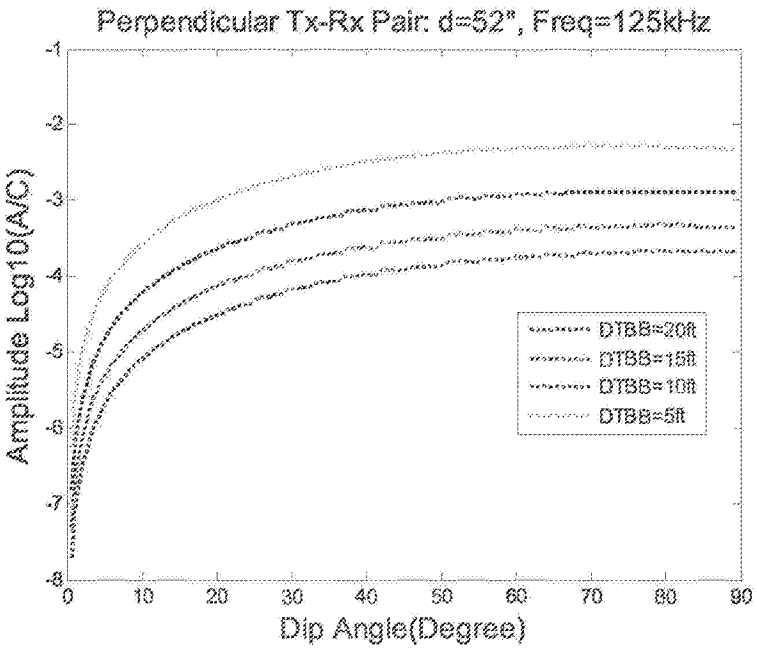
Figure 6A:
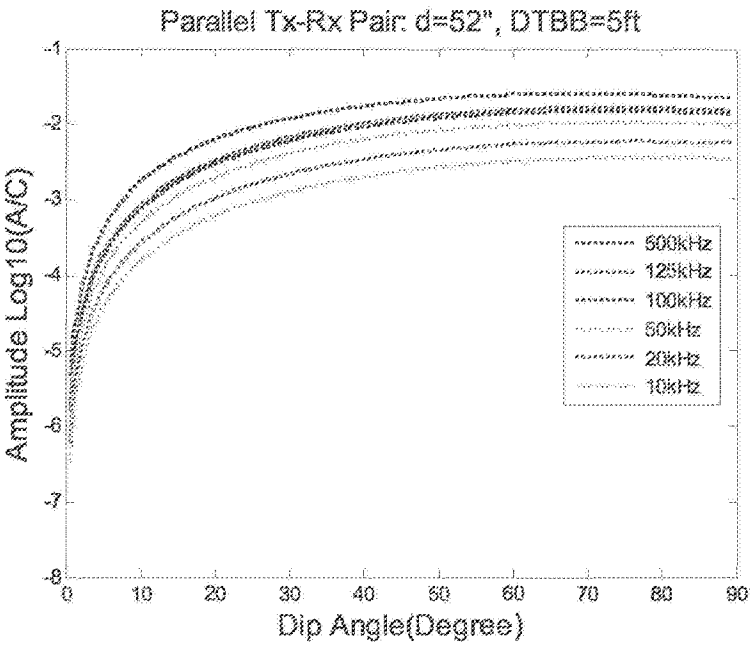
FIGS. 6A and 6B are modeled tool responses to a nearby boundary as a function of frequency and dip angle.
Figure 6B:
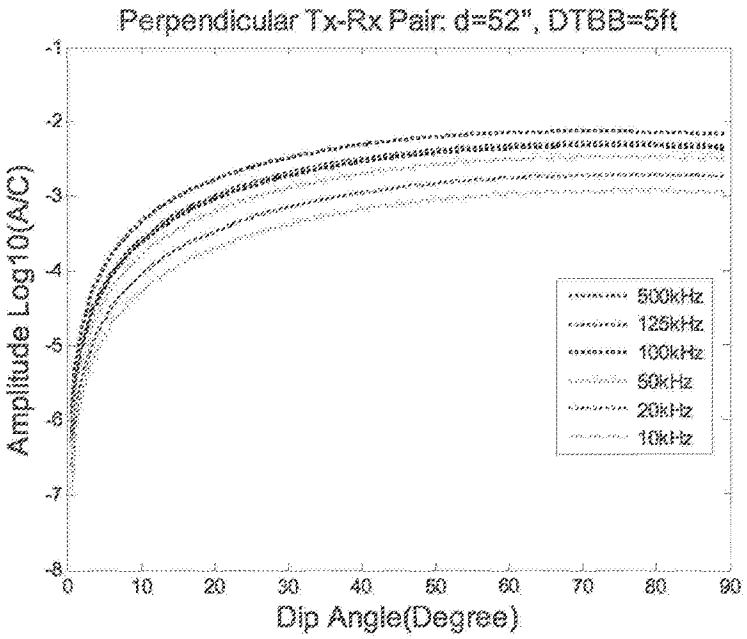

FIGS. 5A and 5B show the tool's parallel and perpendicular responses to a nearby bed boundary as a function of dip angle and boundary distance. For these graphs, the tool is assumed to have an antenna spacing of 52 inches and a signal frequency of 125 kHz. The tool's response grows stronger as the distance to bed boundary shrinks, and the signal remains fairly steady so long as the dip angles are greater than about 10 degrees. Below this, the model symmetry increases and the measurements drop sharply. The nearby bed boundary measurements are also shown in FIGS. 6A and 6B as a function of signal frequency, confirming again that the tool response increases as a function of frequency, though less dramatically than in the first model.

Figure 7B:
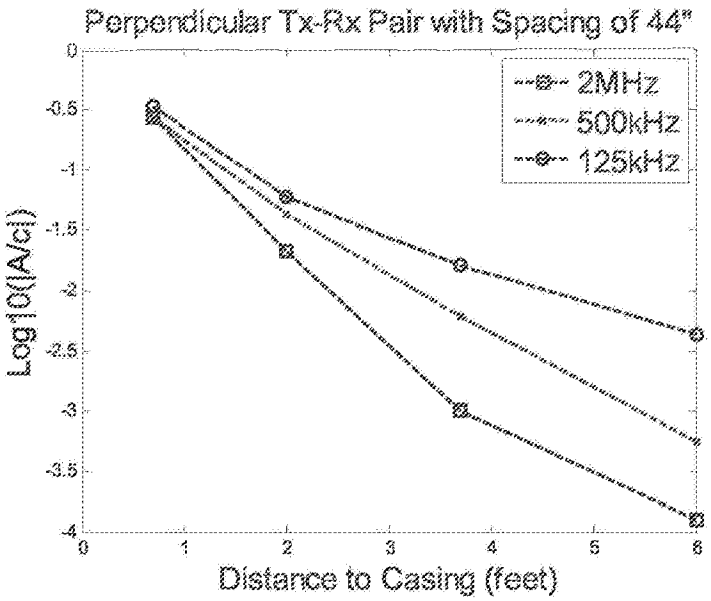
FIGS. 7A and 7B are experimental 44" tool responses to a nearby casing as a function of casing distance and frequency.
Figure 7A:
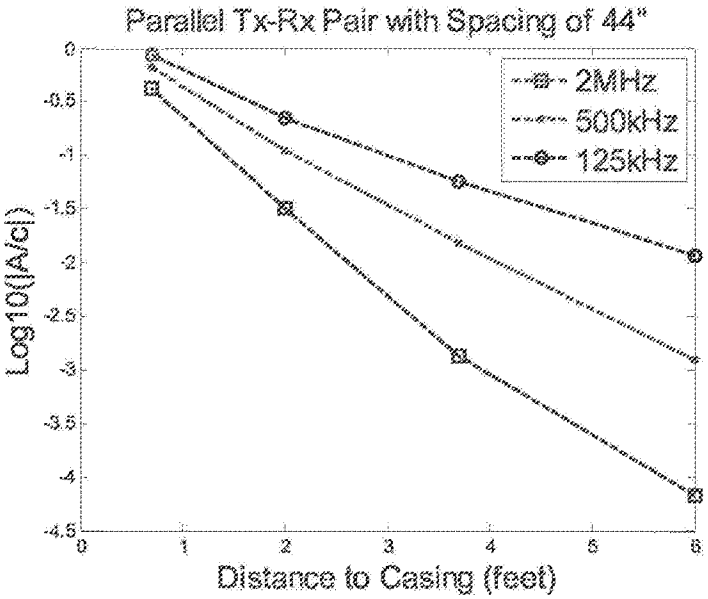
Figure 8A:
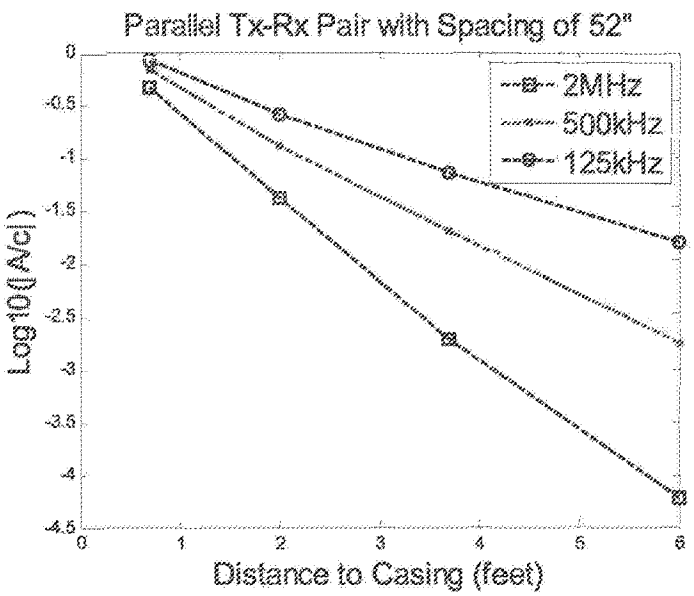
FIGS. 8A and 8B are experimental 52" tool responses to a nearby casing as a function of casing distance and frequency.
Figure 8B:
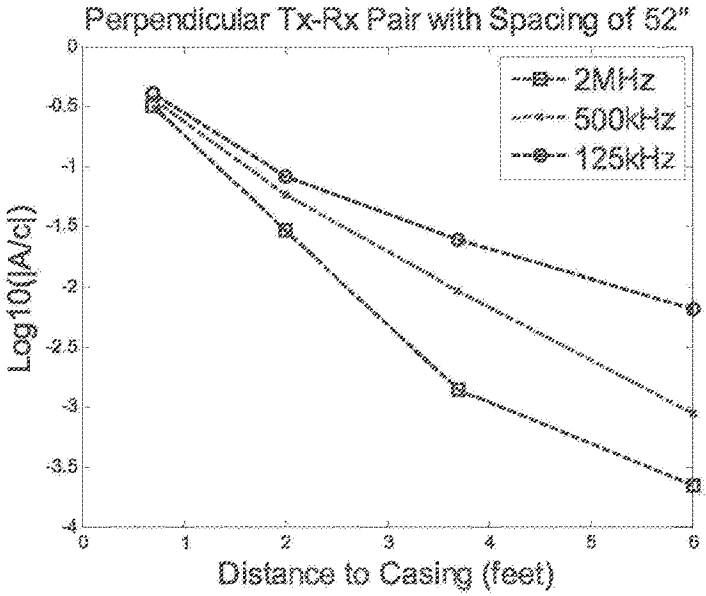
Figure 12A:
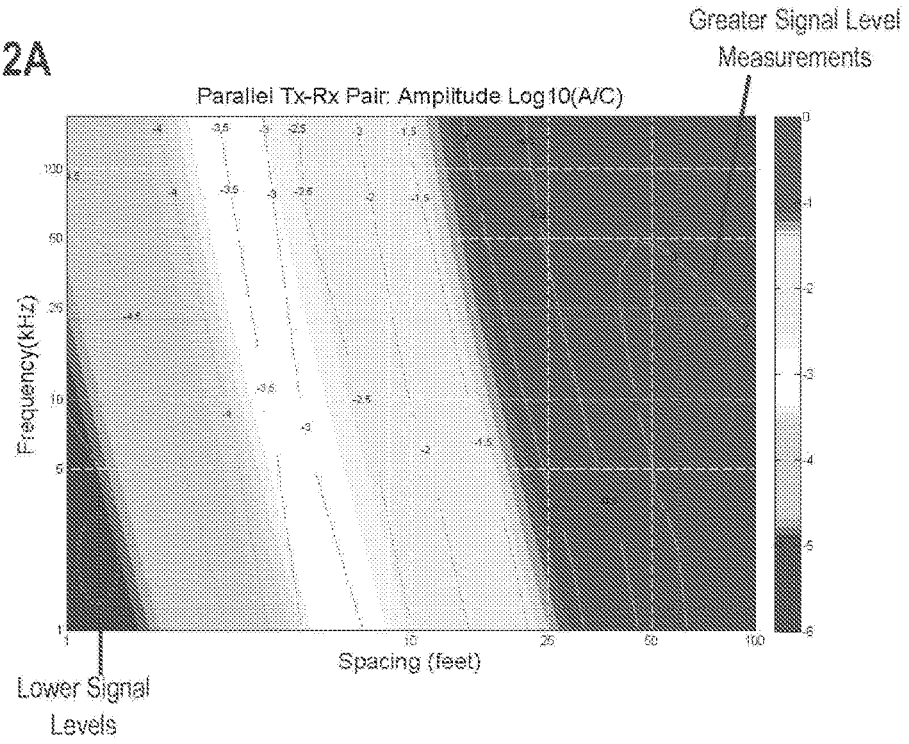
FIGS. 12A and 12B are signal responses of a parallel and perpendicular transmitter-receiver pair, respectively, as a function of antenna spacing and frequency.
Figure 12B:
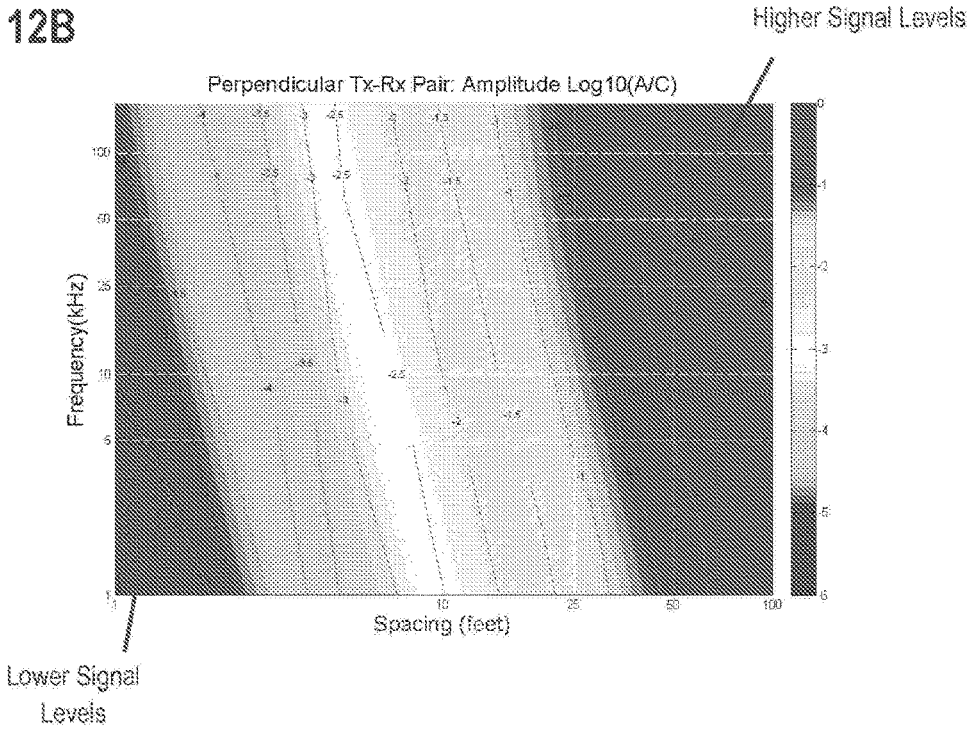

FIGS. 7A and 7B show the tool's parallel and perpendicular responses to a nearby well casing as a function of casing distance and signal frequency, assuming a 44 inch antenna spacing. FIGS. 8A and 8B show the expected responses for a tool having a 52 inch antenna spacing. These responses represent actual measurements obtained via a water tank experiment in which the tank was filled with 1 Ω·m water to represent a homogeneous isotropic formation. The tool was positioned in the center of the tank and a casing tubular was positioned parallel to the tool at a distance that could be varied as desired from 0.85 feet to 6 foot. These figures suggest that signal strength increases as signal frequency decreases. Even though this trend is not monotonic and it reverses slightly at lower signal frequencies (see FIGS. 12A-12B), the discrimination between the tool's response to casing and the tool's response to other environmental factors is expected to improve as the signal frequency is reduced. Significantly, the use of lower signal frequencies also enables feasible tool operation at increased antenna spacings.

Figure 9B:
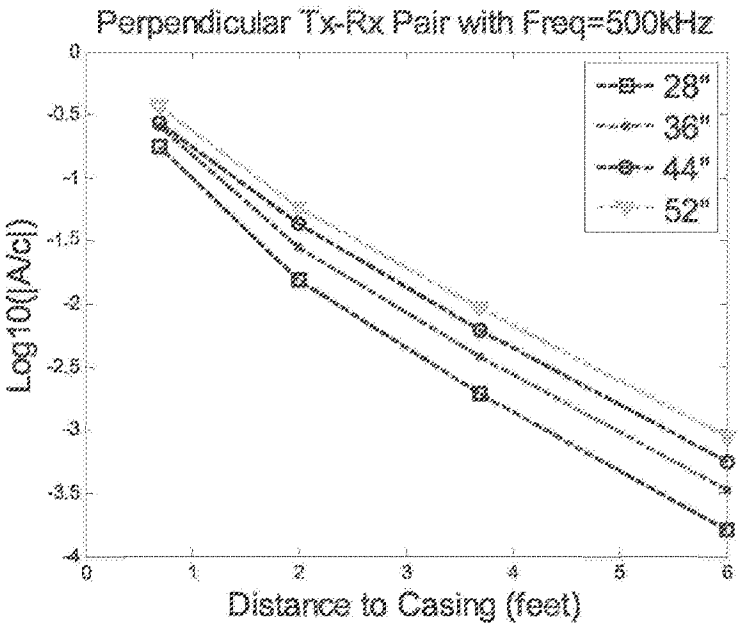
FIGS. 9A and 9B are experimental tool responses to a nearby casing as a function of casing distance and antenna spacing.
Figure 9A:
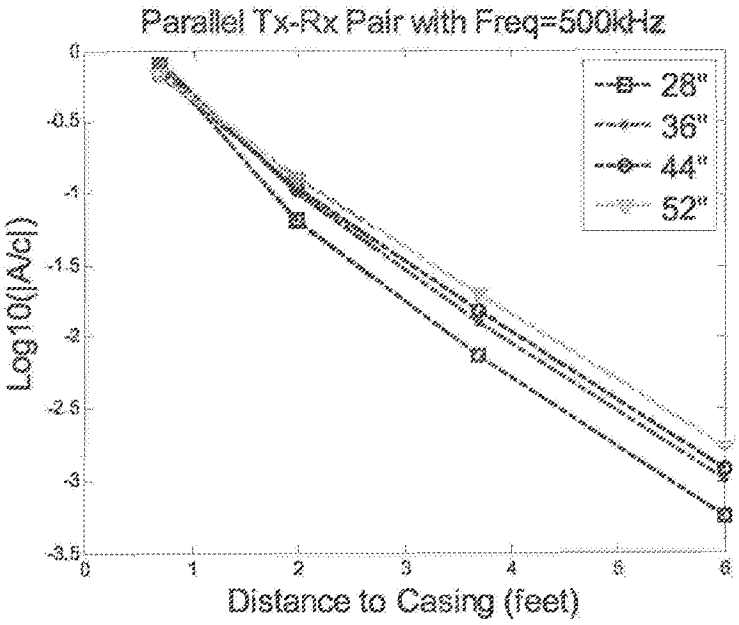

FIGS. 9A and 9B show the parallel and perpendicular responses of the tool as a function of casing distance for different antenna spacings, assuming a signal frequency of 500 kHz. From this graph it can be observed that the tool's response to signal strength increases with antenna spacing. A comparison of the tool's responses to each of the models reveals that a casing detection tool would benefit from using a lower tool operating frequency and/or longer spacing between tool's transmitter and receiver, as this increases the tool's sensitivity to nearby casing and simultaneously decreasing the tool's response to formation anisotropy and nearby shoulder beds.

On the other hand, reducing frequency also raises a couple of issues. First of all, lower frequency reduces the signal amplitude received at tool's receiver when other specifications of the tool are consistent (same spacing, same antenna design, etc.). Noise level or signal-to noise ratio will be a challenging issue for very weak signal amplitude. Secondly, the majority of received signal at a receiver is the direct signal transmitted directly from the transmitter to the receiver if operated at low frequency. Processing schemes to determine a casing nearby the tool may fail if direct signal is much stronger than signal from casing. In summary, it would be beneficial to reduce operating frequency for a nearby casing detection, but different formation resistivity and different casing distance to the tool define the optimized operating frequency as well as the optimized spacing between transmitter and receiver.

Figure 10:
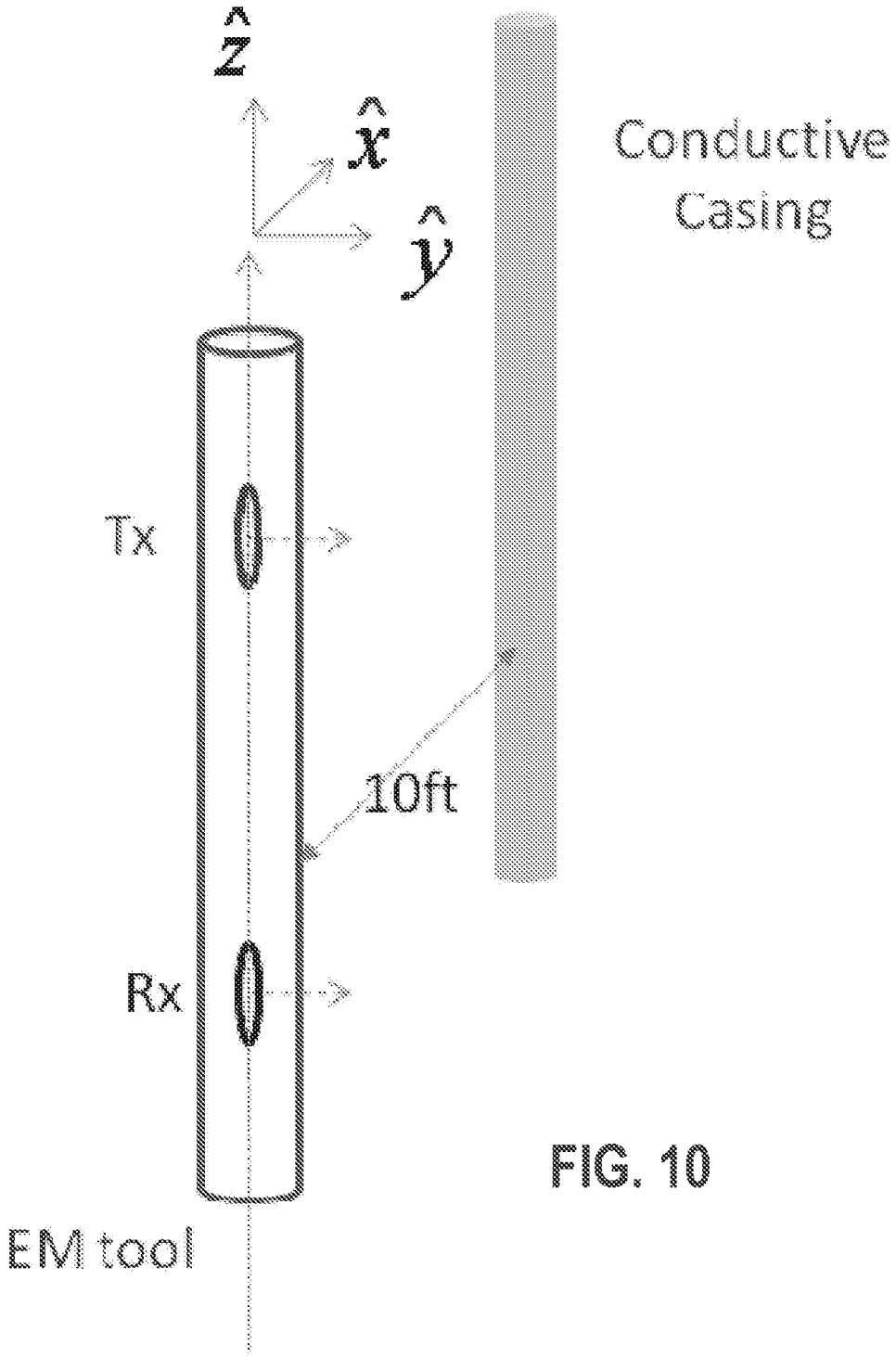
FIG. 10 shows a tool model that serves as a basis for a casing sensitivity calculation.

To better quantify considerations that may go into an optimization analysis, we take as an example an electromagnetic logging tool located in a homogeneous isotropic formation with resistivity of 50 Ω·m with a parallel casing string at a distance of 10 feet, as indicated in FIG. 10. The tool's sensitivity to the casing can be characterized by measuring the relative strength of the signal attributable to the casing. The casing signal is maximized when the antennas are oriented along the y-axis as shown in FIG. 10, as this orientation induces the maximum current flow in the casing and provides the maximum sensitivity to the fields induced by this current flow. The complex amplitude of the signal component measured by this trasmitter and receiver orientation is herein referred to as $V_y^y$). The tool sensitivity can then be expressed by comparing the relative strength of the modeled signal ($V_y^y$) in the presence and absence of the casing:

$$\text{Sensitivity} = \left| \frac{\text{Signal}_{with\ Casing} - \text{Signal}_{no\ Casing}}{\text{Signal}_{no\ Casing}} \right| \times 100\ (\%) \tag{2}$$

Figure 11A:
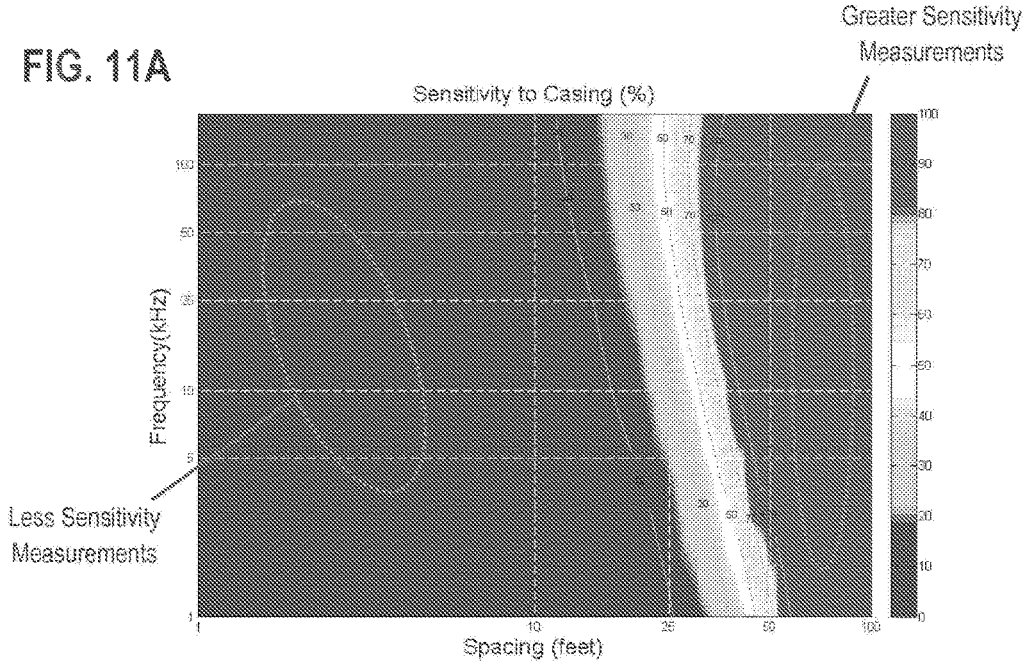
FIG. 11A shows tool sensitivity as a function of antenna spacing and frequency.

FIG. 11A shows this sensitivity as a function of antenna spacing and signal frequency. The unscaled signal amplitude with casing ($\log_{10} V_y^y$) is shown in FIG. 11B, again as a function of antenna spacing and signal frequency. The tool designer may employ these figures in conjunction with FIGS. 12A and 12B, which show modeled responses of log 10(A/C) for the parallel Tx-Rx antenna pair and perpendicular Tx-Rx antenna pair shown in FIG. 2, for the same range of signal frequencies and antenna spacings of FIGS. 11A and 11B. Collectively, these figures can be used by the tool designers to select an optimized frequency and antenna spacing to implement an EM tool customized for a nearby casing detection range of 10 feet in a formation having 50 Ω·m resistivity.

Figure 11B:
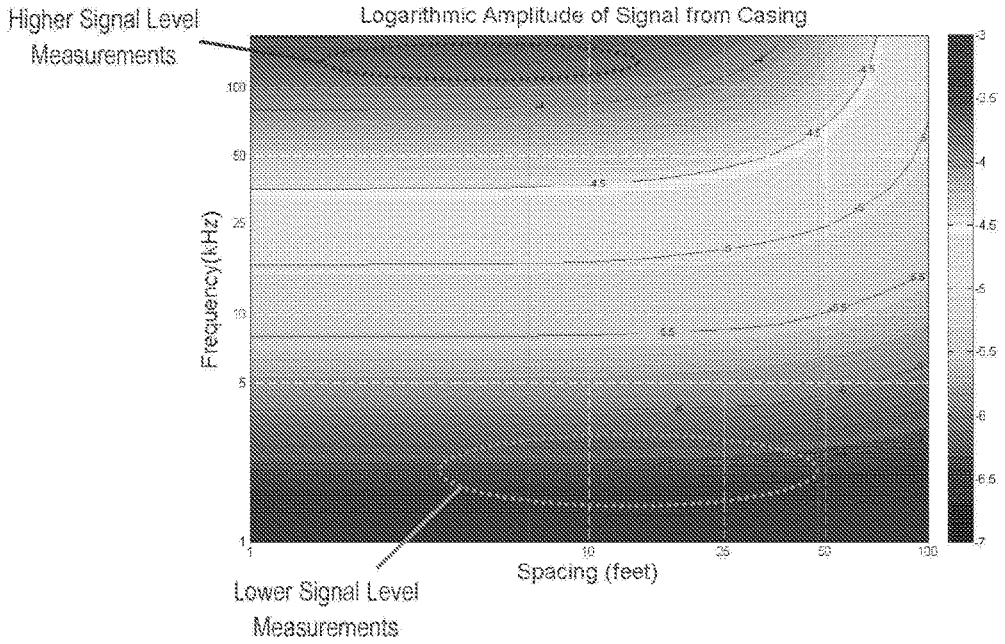
FIG. 11B shows tool signal levels as a function of antenna spacing and frequency.

For example, FIG. 11A shows that a sensitivity of 100% can be obtained with, e.g., a transmit signal frequency of 100 kHz and an antenna spacing on the order of 35 feet; a transmit signal frequency of 10 kHz and an antenna spacing on the order of 40 feet; and a transmit signal frequency of 1 kHz with an antenna spacing on the order of 50 feet. FIG. 11B shows that the amplitude of the signal component attributable to the casing is about −4.2, −5.5, and −6.8, respectively, for these values, which are all acceptably strong enough. Transporting these values (100 kHz with 35 feet, 10 kHz with 40 feet, and 1 kHz with 50 feet) to FIGS. 12A and 12B, the designer observes that the scaled tool responses are expected to be in excess of −0.5.

Figure 13A:
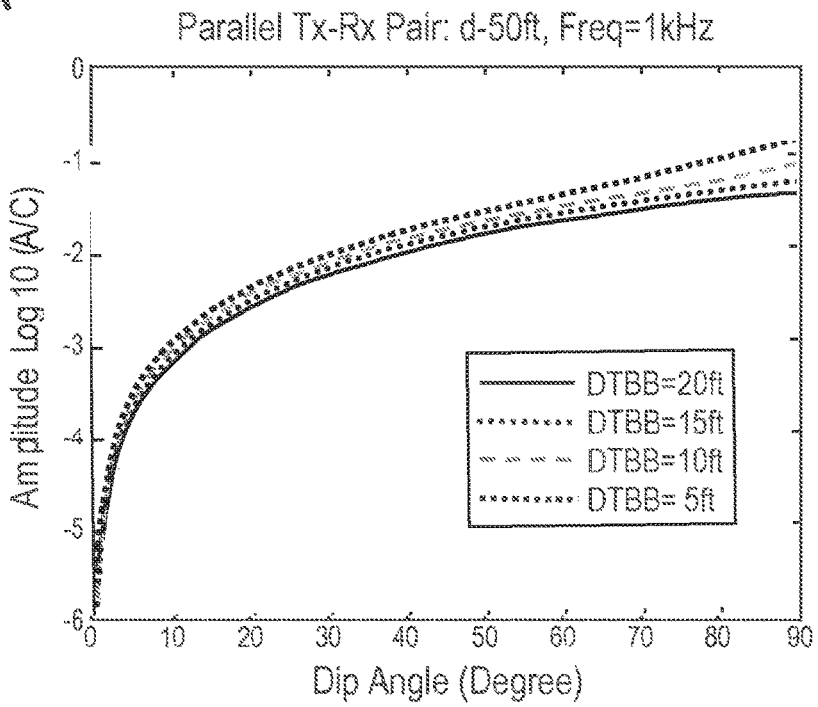
FIGS. 13A and 13B are modeled 50' tool responses as a function of casing distance and dip angle.
Figure 13B:
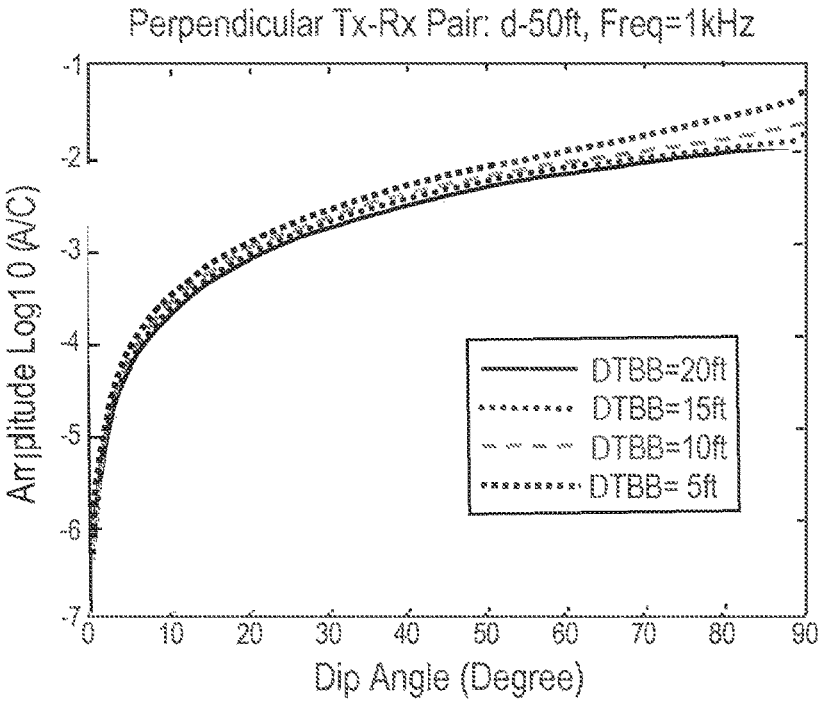

Since the formation resistivity is assumed to be relatively high (50 Ω·m), formation anisotropy effects will be negligible compared to shoulder bed effects. The designer estimates the shoulder bed response with selected tool parameters. FIGS. 13A and 13B show modeled shoulder bed responses where a tool having a 50 foot antenna spacing and a transmit signal frequency of 1 kHz is positioned in a 50 Ω·m at some distance from the boundary with a 1 Ω·m formation. The response is shown as a function of bed boundary distance and dip. FIGS. 13A and 13B indicate that the highest bed boundary signal of log 10(A/C) is less than −1, which confirms the tool is able to accurately determine a parallel casing 10 feet away from the tool in 50 Ω·m formation without considerations of other formation effects, such as anisotropy and/or shoulder beds.

Figure 14:
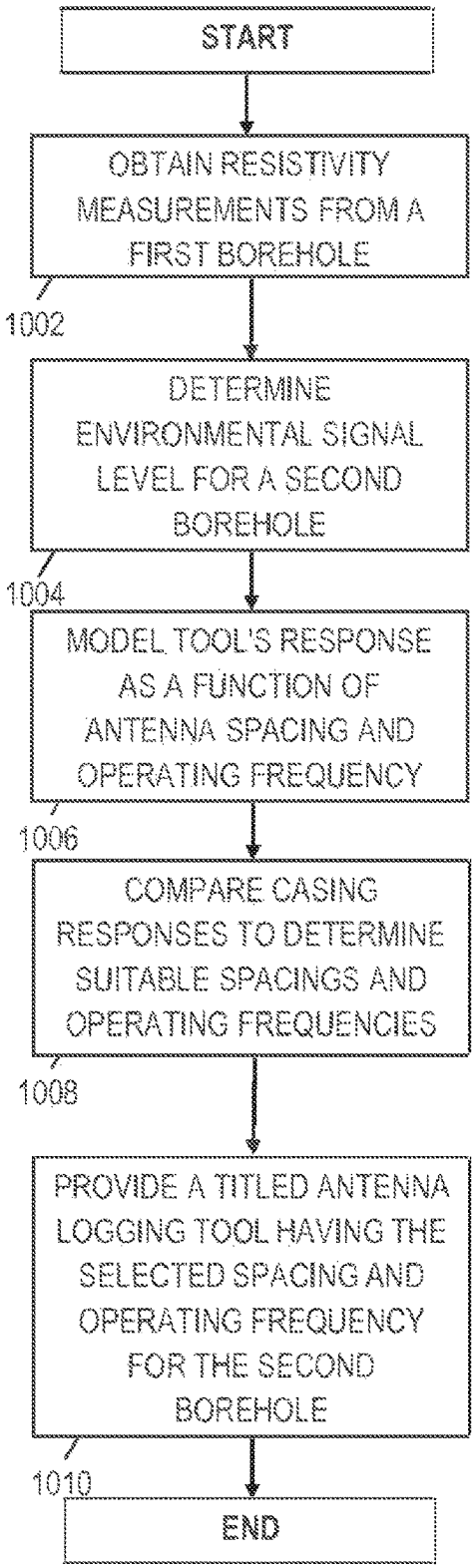
FIG. 14 is a flow diagram of an illustrative casing detection method.

FIG. 14 is a flow diagram of an illustrative casing detection method. The illustrative method begins by obtaining resistivity measurements from a first borehole, as shown in block 1002. This first borehole is then cased or otherwise made conductive (e.g., by filling it with a conductive fluid). In situations where a cased well already exists and its resistivity logs are unavailable, the resistivity of the formation around the cased well may be estimated based on other information such as remote wells, seismic surveys, and reservoir models. The resistivity data for the formation containing the first borehole may then be employed in block 1004 to predict environmental signals levels that would be encountered by a second borehole drilled near the first. Based on the resistivity measurements, a modeled tool response to environmental effects such as resistive anisotropy and nearby formation bed boundaries or fluid interfaces can be determined along the length of a second borehole path as a function of antenna spacing and transmit signal frequency.

The resistivity data may be further employed in block 1006 to model the tool's response signal level to casing as a function of antenna spacing and operating frequency. An upper limit on the desired casing detection range may be used as part of the modeling process. In block 1008, the casing response may be compared to the environmental signal levels to determine a range of acceptable antenna spacings and a range of suitable operating frequencies. The range may be determined to be a combination of spacing and frequency that provides a casing signal greater than the anticipated environmental signal response, and in some cases at least an order of magnitude greater. Such significant disparity would enable casing ranging measurements to be made while neglecting environmental signal responses. In block 1010 a tilted antenna tool is provided with an antenna spacing and operating frequency from the range of suitable values. The selected values may be based upon available tools or feasible tool configurations. For example, the available tool hardware may require some minimum required receive signal strength to assure adequate receiver response, and this factor may prevent certain combinations of antenna spacing and signal frequency from being chosen. As another example, some tilted antenna tools may have a modular construction in which the transmit module can be spaced at a variable distance from the receive module, thereby providing for a reconfigurable antenna spacing within certain limits. Or the available tilted antenna tools may have a programmable operating frequency range or they may employ multiple operating frequencies including at least one in the designated operating range.

These and other variations and modifications will become apparent to those skilled in the art once the above disclosure is fully appreciated. It is intended that the following claims be interpreted to embrace all such variations and modifications.

What is claimed is:

1. A method comprising:

obtaining formation resistivity measurements from a borehole;

determining an expected environmental signal level for the borehole based, at least in part, on the formation resistivity measurements;

selecting at least one of a transmitter-receiver spacing and an operating frequency to provide a casing detection signal level for the borehole which is greater than the expected environmental signal level; and providing a tilted antenna logging tool having the selected transmitter-receiver spacing and/or operating frequency in a bottomhole assembly for the borehole.

2. The method of claim 1, wherein the casing detection signal level is less than ten times the expected environmental signal level.

3. The method of claim 1, wherein the borehole is cased before obtaining the formation resistivity measurements from the borehole.

4. The method of claim 1, wherein the tilted antenna logging tool comprises antenna modules that can be separated by a variable number of intervening subs.

5. The method of claim 1, wherein the tilted antenna logging tool has a programmable operating frequency.

6. The method of claim 1, wherein the expected environmental signal level includes an azimuthal signal dependence attributable to formation anisotropy.

7. The method of claim 1, wherein the expected environmental signal level includes an azimuthal signal dependence attributable to a formation fluid interface or a bed boundary.

8. The method of claim 1, wherein the expected environmental signal level includes an azimuthal signal dependence attributable to a borehole effect.

9. The method of claim 1, wherein determining the expected environmental signal level comprises generating a model response based, at least in part, on a tentative transmitter-receiver spacing and a tentative operating frequency.

10. The method of claim 9, wherein selecting at least one of the transmitter-receiver spacing and the operating frequency to provide the casing detection signal level for the borehole comprises:

determining a model response for the casing detection signal level based, at least in part, on the tentative transmitter-receiver spacing and operating frequency; and varying the tentative transmitter-receiver spacing and the tentative operating frequency until the modeled casing detection signal level exceeds the modeled environmental signal level.

11. A casing detection tool comprising:

a tilted transmitter antenna that emits a transmit signal at a plurality of operating frequencies;

one or more tilted receiver antennas that detect components of an induced magnetic field resulting from the emitted transmit signal, wherein the receiver antennas are a spacing distance from the tilted transmitter antenna;

a processor; and a machine-readable medium having program code executable by the processor to cause the casing detection tool to, determine an expected environmental signal level for a borehole; and analyze the detected components corresponding to different antenna spacings and different frequencies to identify detected components that provide a casing detection signal level greater than the expected environmental signal level.

12. The tool of claim 11, wherein the spacing distance is based on the expected environmental signal level that includes at least one of a dependence on formation anisotropy, a dependence on a formation fluid interface, a dependence on a bed boundary, and a dependence on a borehole effect.

13. The tool of claim 11, wherein the identified detected components are associated with a spacing distance greater than about 35 feet and an operating frequency below about 100 kHz.

14. The tool of claim 11, wherein the identified detected components are associated with a spacing distance greater than about 40 feet and an operating frequency below about 10 kHz.

15. The tool of claim 11, wherein the identified detected components are associated with a spacing distance greater than about 50 feet and an operating frequency below about 1 kHz.

16. The tool of claim 11, wherein the transmit signal has a programmable operating frequency.

17. The tool of claim 16, wherein the casing detection tool has a number of intermediate subs between the transmitter antenna and at least one receiver antenna, wherein the number is variable to provide at least the selected spacing distance.

18. The tool of claim 11 further comprising program code executable by the processor to cause the casing detection tool to obtain formation resistivity measurements from the borehole using a spacing distance and an operating frequency associated with the identified detected components that provide a casing detection signal level greater than the expected environmental signal level.

19. One or more non-transitory machine-readable media comprising program code, the program code to:

obtain first formation resistivity measurements from a tilted antenna logging tool disposed in a borehole;

determine an expected environmental signal level for the borehole based, at least in part, on the first formation resistivity measurements;

select at least one of a transmitter-receiver spacing and an operating frequency to provide a casing detection signal level for the borehole which is greater than the expected environmental signal level; and obtain second formation resistivity measurements from the tilted antenna logging tool at the selected transmitter-receiver spacing and/or operating frequency.

20. The machine-readable media of claim 19, wherein the program code to determine the expected environmental signal level comprises program code to generate a model response based, at least in part, on a tentative transmitter-receiver spacing and a tentative operating frequency.

* * * * *